US009091985B2

(12) United States Patent
Hata

(10) Patent No.: US 9,091,985 B2
(45) Date of Patent: Jul. 28, 2015

(54) IMAGE FORMING APPARATUS

(71) Applicant: CANON KABUSHIKI KAISHA, Tokyo (JP)

(72) Inventor: Yousuke Hata, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/095,192

(22) Filed: Dec. 3, 2013

(65) Prior Publication Data

US 2014/0178085 A1 Jun. 26, 2014

(30) Foreign Application Priority Data

Dec. 20, 2012 (JP) ..... 2012-277699

(51) Int. Cl.
*G03G 15/00* (2006.01)
*G03G 15/01* (2006.01)

(52) U.S. Cl.
CPC ..... *G03G 15/5008* (2013.01); *G03G 15/0189* (2013.01); *G03G 15/505* (2013.01); *G03G 2215/0008* (2013.01); *G03G 2215/0158* (2013.01)

(58) Field of Classification Search
CPC ..... G03G 15/505; G03G 15/5008; G03G 2215/0008
USPC ..... 399/36, 40, 167, 298
See application file for complete search history.

(56) References Cited

U.S. PATENT DOCUMENTS

2011/0103818 A1* 5/2011 Itoh ..... 399/71

FOREIGN PATENT DOCUMENTS

JP 2006-58364 A 3/2006

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

The image forming apparatus includes photosensitive drums, drive motors for driving the photosensitive drums, a motor control unit for controlling operations of the drive motors, and a printer control unit. The printer control unit stops rotations of the photosensitive drums at reference positions after a print job is finished. After prescribed time elapses from the end of the print job, microscale driving of the photosensitive drums is performed for a microscale driving time period. Then, drive amounts by the drive motors during the microscale driving are calculated. At the start of a next print job, activation timing of each of the drive motors is adjusted in accordance with the drive amount so as to reduce a variation generated due to the microscale driving.

9 Claims, 14 Drawing Sheets

IMAGE FORMING APPARATUS

BACKGROUND OF THE INVENTION

1. Field of the Invention

The present invention relates to an image forming apparatus for forming a color image.

2. Description of the Related Art

There exists a tandem-type full-color image forming apparatus including a plurality of image forming units corresponding to development colors such as cyan, magenta, yellow, and black arranged thereon along a direction of movement of an intermediate transfer body.

As the tandem-type full-color image forming apparatus, there is known an apparatus which drives the image forming unit for black and the intermediate transfer body commonly by the same drive motor and the image forming units for the other colors by another drive motor. By driving the image forming unit for black by the drive motor different from the drive motor used to drive the image forming units for the other colors, the image forming units of the other colors can be held in a stopped state when the image forming apparatus is operated in a black monochromatic mode in which a monochromatic image is formed by using only the image forming unit for black.

In the full-color image forming apparatus, a color deviation between the colors is required to be reduced so as to enhance image quality. Therefore, rotation phases of photosensitive drums for the respective colors are required to be registered with each other. In particular, the photosensitive drum corresponding to black is driven by the drive motor different from that for the photosensitive drums corresponding to yellow, magenta, and cyan. Therefore, the rotation phase of the photosensitive drum corresponding to black and the rotation phases of the other photosensitive drums are required to be registered with each other.

An adjustment to register the rotation phases of the plurality of photosensitive drums takes long time. Therefore, if the rotation phases are adjusted at the start of image formation, it takes long time to start forming a print. Japanese Patent Application Laid-open No. 2006-58364 discloses a technology of detecting the rotation phases of the plurality of photosensitive drums to adjust the phases.

Toners (recording agents) used to form the images are collected from the photosensitive drums by cleaning blades so as not to remain thereon. However, when the image formation is not performed for a long period of time and therefore the photosensitive drums are not rotationally driven, a residual toner (residual recording agent) between the photosensitive drum and the cleaning blade sometimes firmly adheres to a surface of the photosensitive drum. In order to prevent the adhesion of the residual toner, in the image forming apparatus, microscale driving is performed for all the photosensitive drums at constant time intervals in the case where the image formation is not performed for a predetermined period of time.

Even when the photosensitive drums are stopped after the rotation phases of the photosensitive drums are registered with each other at the end of a printing operation as described in Japanese Patent Application Laid-open No. 2006-58364, there is a risk in that the rotation phases of the photosensitive drams are misregistered at the start of a next operation due to the microscale driving repeated at constant time intervals. If the photosensitive drums are activated in this state, the image quality is degraded because of a misregistration between the rotation phases of the photosensitive drums. Moreover, in the case where the rotation phases of the photosensitive drums are registered with each other again when the photosensitive drums are activated, it takes long time to start outputting the print.

SUMMARY OF THE INVENTION

The present invention has been made to solve the conventional problems described above, and therefore has an object to rotationally drive photosensitive members (photosensitive drums) after an image formation operation of the photosensitive members is stopped so as to prevent a residual recording agent from firmly adhering to the photosensitive members and to reduce time required for phase registration at the time of activation of the photosensitive members.

In order to attain the above-mentioned object, according to one embodiment of the present invention, there is provided an image forming apparatus for forming a color image, including:

a first photosensitive member and a second photosensitive member;

a first motor and a second motor configured to rotate the first photosensitive member and the second photosensitive member, respectively;

a detection section configured to detect rotation phases of the first photosensitive member and the second photosensitive member;

a stop processing section configured to control the first motor and the second motor to stop the first photosensitive member and the second photosensitive member such that the rotation phase of the first photosensitive member and the rotation phase of the second photosensitive member have predetermined relations based on the detected rotation phases of the first photosensitive member and the second photosensitive member, after the end of image formation;

a control section configured to control the first motor and the second motor without an image formation instruction to rotate the first photosensitive member and the second photosensitive member, respectively, after the stop processing by the stop processing section;

a calculation unit configured to calculate a first rotation amount of the first photosensitive member and a second rotation amount of the second photosensitive member after the stop processing by the stop processing section; and a startup control section configured to control the first motor and the second motor to perform a startup process of the first photosensitive member and a startup process of the second photosensitive member based on the first rotation amount and the second rotation amount.

Further features of the present invention will become apparent from the following description of exemplary embodiments (with reference to the attached drawings).

DESCRIPTION OF THE EMBODIMENTS

Now, an embodiment of the present invention is described in detail referring to the accompanying drawings.

Figure 1:
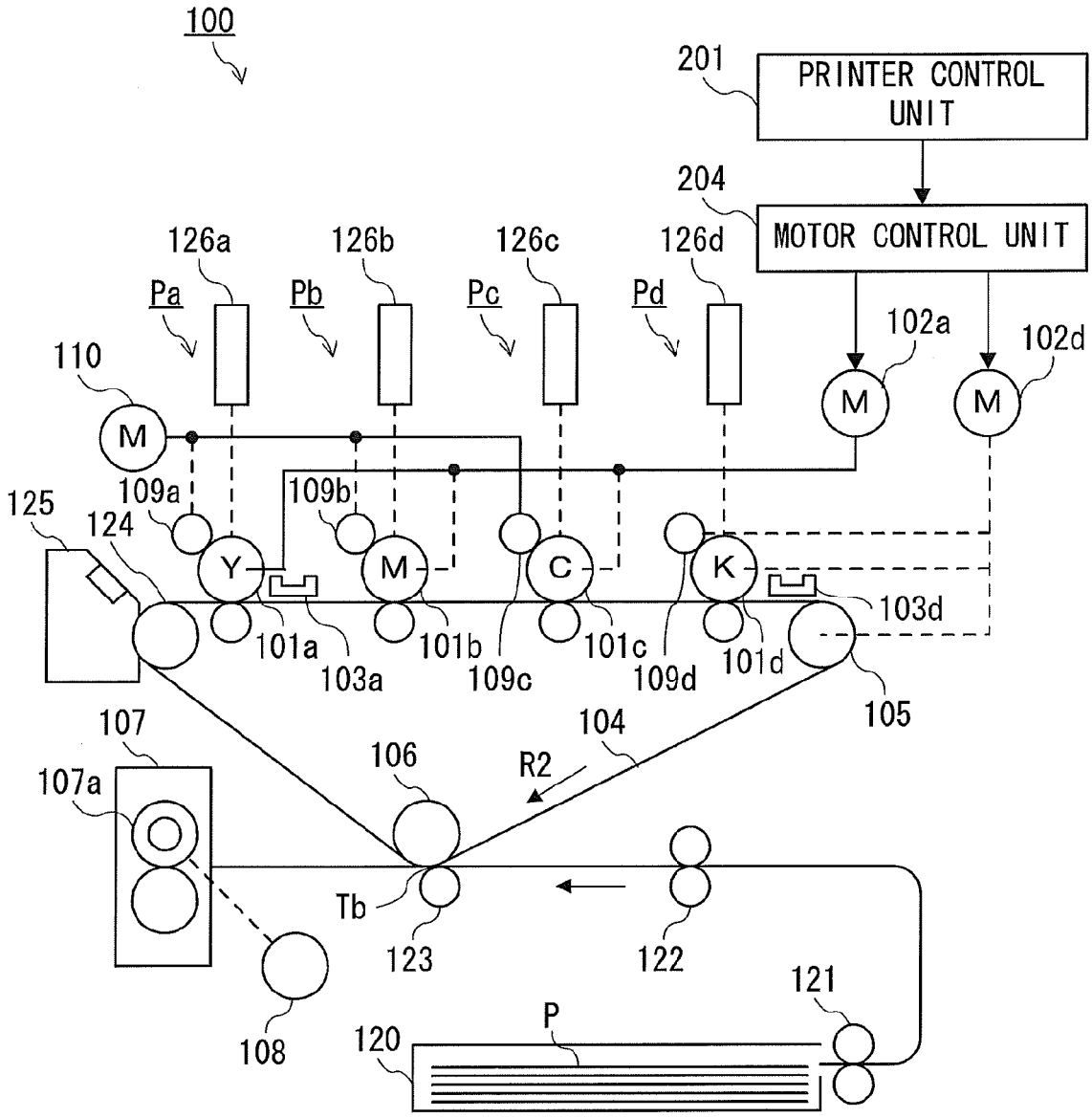
FIG. 1 is an overall configuration diagram of an image forming apparatus according to this embodiment.

FIG. 1 is an overall configuration diagram of an image forming apparatus according to this embodiment.

An image forming apparatus 100 is a tandem-type full-color image forming apparatus including image forming units Pa, Pb, Pc, and Pd respectively corresponding to yellow, magenta, cyan, and black, which are arranged along an intermediate transfer belt 104.

The image forming unit Pa forms a yellow toner image on a photosensitive drum 101*a* which is a photosensitive member, by an exposure section 126*a* and a development sleeve 109*a*. Similarly, the image forming unit Pb forms a magenta toner image on a photosensitive drum 101*b* which is a photosensitive member, by an exposure section 126*b* and a development sleeve 109*b*. The image forming unit Pc forms a cyan toner image on a photosensitive drum 101*c* which is a photosensitive member, by an exposure section 126*c* and a development sleeve 109*c*. The image forming unit Pd forms a black toner image on a photosensitive drum 101*d* which is a photosensitive member, by an exposure section 126*d* and a development sleeve 109*d*. The toner images respectively formed on the photosensitive drums 101*a*, 101*b*, 101*c*, and 101*d* are primarily transferred to the intermediate transfer belt 104 so as to sequentially overlap each other. The image forming unit Pa includes a phase detection sensor 103*a*, whereas the image forming unit Pd includes a phase detection sensor 103*d*, which are described later.

The intermediate transfer belt 104 is stretched around a tension roller 124, a drive roller 105, and an opposed roller 106 so as to be supported thereby. The intermediate transfer belt 104 is driven by the drive belt 105 to rotate at a predetermined processing speed in a direction indicated by the arrow R2. A secondary transfer roller 123 is held in contact with the intermediate transfer belt 104 having an inner side surface supported by the opposed roller 106 to form a secondary transfer section Tb. The opposed roller 106 is grounded. By the application of a DC voltage to the secondary transfer roller 123, the toner images of the four colors, which are primarily transferred to the intermediate transfer belt 104, are secondarily transferred to a recording medium P such as a sheet of paper in a collective manner.

A belt cleaning section 125 brings a cleaning blade in slide contact with the intermediate transfer belt 104 so as to collect a transfer residual toner remaining on the intermediate transfer belt 104 after the passage of the intermediate transfer belt 104 through the secondary transfer section Tb.

The recording media P are stored in a recording-material cassette 120, and are drawn one by one by separation rollers 121 so as to be fed to registration rollers 122. The registration rollers 122 stop the recording medium P. Then, the registration rollers 122 feed the recording medium P in synchronization with the toner images which are primarily transferred to the intermediate transfer belt 104. The recording medium P, on which the toner images of the four colors are secondarily transferred, is heated and pressurized in a fixing section 107 so that the images are fixed onto a surface of the recording medium P. Thereafter, the recording medium P is delivered to the outside of the image forming apparatus 100.

The photosensitive drums 101*a*, 101*b*, and 101*c* are driven by a drive motor 102*a*. The development sleeves 109*a*, 109*b*, and 109*c* are driven by a drive motor 110. The photosensitive drum 101*d*, the drive roller 105, and the development sleeve 109*d* are driven by a drive motor 102*d*. As described above, the plurality of photosensitive drums 101*a*, 101*b*, 101*c*, and 101*d* are driven by at least two drive motors 102*a* and 102*d*. As each of the drive motors 102*a*, 102*d*, and 110, a brushless motor is used, for example. In the following, the drive motor 102*a* is referred to as a "color motor 102*a*", whereas the drive motor 102*d* is referred to as a "monochrome motor 102*d*".

Figure 2A:
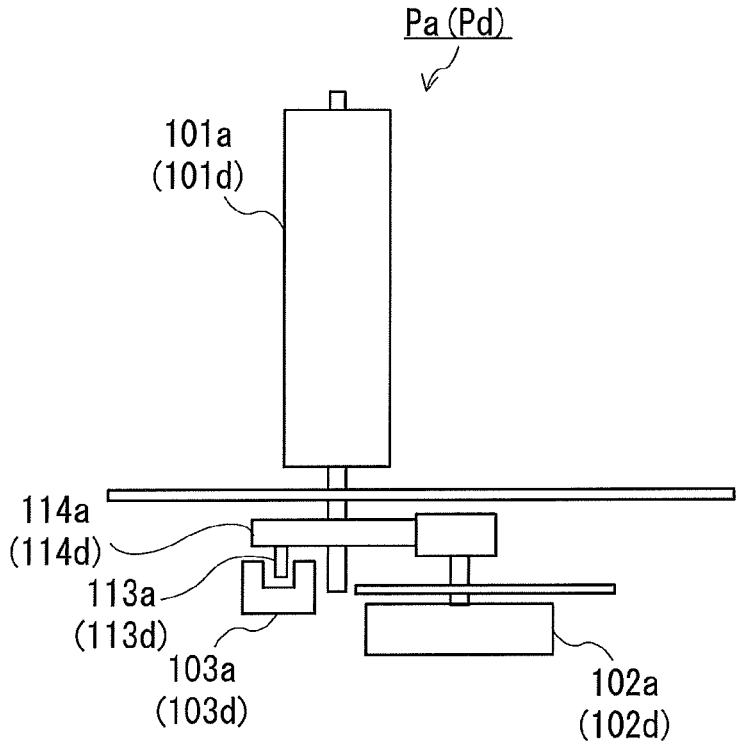
FIG. 2A is an explanatory view of a phase detection sensor.
Figure 2B:
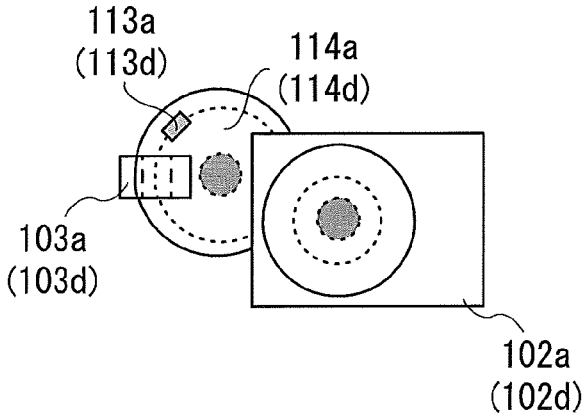
FIG. 2B is another explanatory view of the phase detection sensor.

FIGS. 2A and 2B are explanatory views illustrating the phase detection sensor (photointerrupter) 103*a* (103*d*) provided to the image forming unit Pa (Pd).

A gear 114*a* (114*d*) for driving the photosensitive drum 101*a* (101*d*) is provided to the photosensitive drum 101*a* (101*d*). The gear 114*a* (114*d*) is driven by the color motor 102*a* (monochrome motor 102*d*) to rotate integrally with the photosensitive drum 101*a* (101*d*). A flag 113*a* (113*d*) is provided to the gear 114*a* (114*d*). The phase detection sensor 103*a* (103*d*) outputs a detection signal by, for example, the interruption of an optical path. The phase detection sensor 103*a* (103*d*) outputs one flag detection signal for each revolution of the photosensitive drum 101*a* (101*d*) based on the interruption of the optical path of the phase detection sensor 103*a* (103*d*) by the flag 113*a* (113*d*) along with the rotation of the photosensitive drum 101*a* (101*d*). Based on the flag detection signal described above, the phase detection sensor 103*a* (103*d*) detects a rotation phase of the photosensitive drum 101*a* (101*d*).

A plurality of the flags 113*a* (113*d*) may be provided to the gear 114*a* (114*d*) at constant intervals in an annular pattern. In this case, a plurality of the flag detection signals are output for one revolution of the photosensitive drum 101*a* (101*d*). In this manner, the rotation phase can be detected more precisely. By setting the size of only one of the plurality of flags 113*a* (113*d*) larger than the other(s), the phase serving as a reference can be determined.

Figure 3:
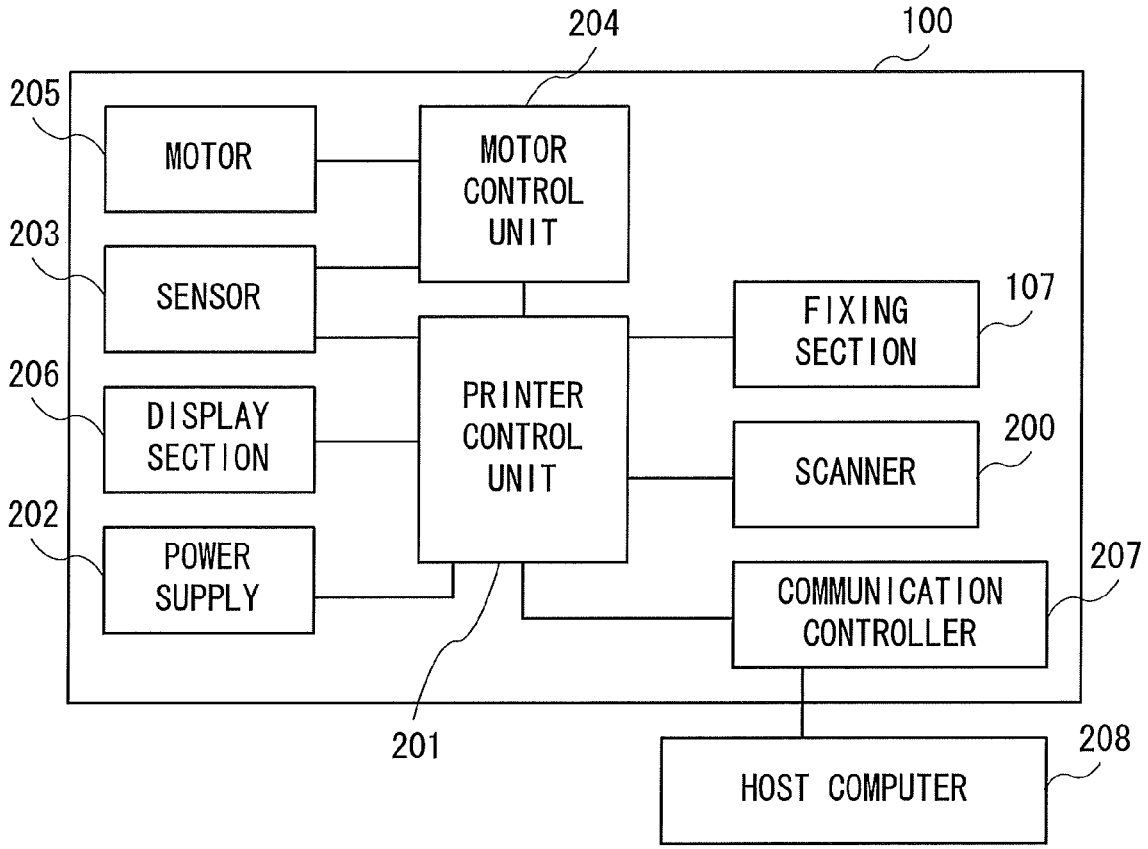
FIG. 3 is a configuration diagram of a control system.

FIG. 3 is a configuration diagram of a control system which controls an operation of the image forming apparatus 100.

A printer control unit 201 controls an operation of each of the units and sections included in the image forming apparatus 100. A power supply 202 supplies power to each of the units and sections included in the image forming apparatus 100. A display section 206 displays an image for visually notifying a user of an operating condition of the image forming apparatus 100. A communication controller 207 controls communication between the printer control unit 201 and a host computer 208 provided outside of the image forming apparatus 100. The host computer 208 is a device for transferring data of a print job for allowing the image forming apparatus 100 to perform the image formation. A scanner 200 reads an image of an original at the time of duplication and transfers the readout data to the printer control unit 201. The fixing section 107 performs the above-mentioned operation under the control of the printer control unit 201.

A motor 205 is a power source for each of the units and sections included in the image forming apparatus 100, and includes the color motor 102*a*, the monochrome motor 102*d*, and the drive motor 110. A sensor 203 is a sensor for detecting conditions of each of the units and sections included in the image forming apparatus 100, and includes the phase detection sensors 103*a* and 103*b*.

A motor control unit 204 is realized by a high-speed computation processing circuit. The high-speed computation processing circuit is, for example, a digital signal processor (DSP), an application specific integrated circuit (ASIC), or a central processing unit (CPU). The motor control unit 204 performs control such as phase switching control in response to a rotor position signal output from a DC brushless motor or the start and stop of the motor 205 in response to a control signal output from the printer control unit 201. The motor control unit 204 also compares a speed signal output from the printer control unit 201 and the output from the sensor 203 to control the rotation speed of the motor 205.

Figure 4A:
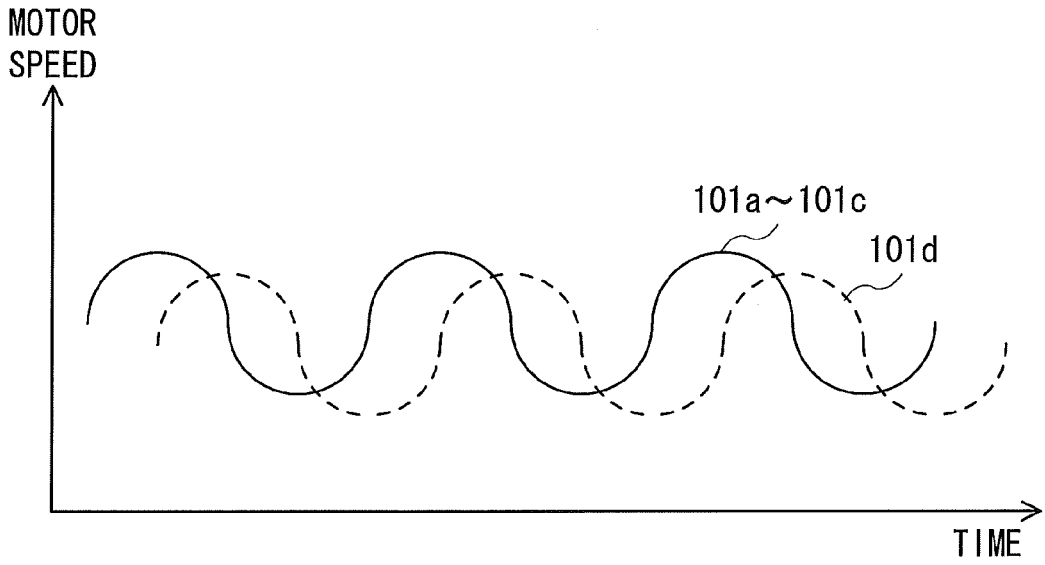
FIG. 4A is an explanatory diagram of a phase difference in rotation between photosensitive drums.
Figure 4B:
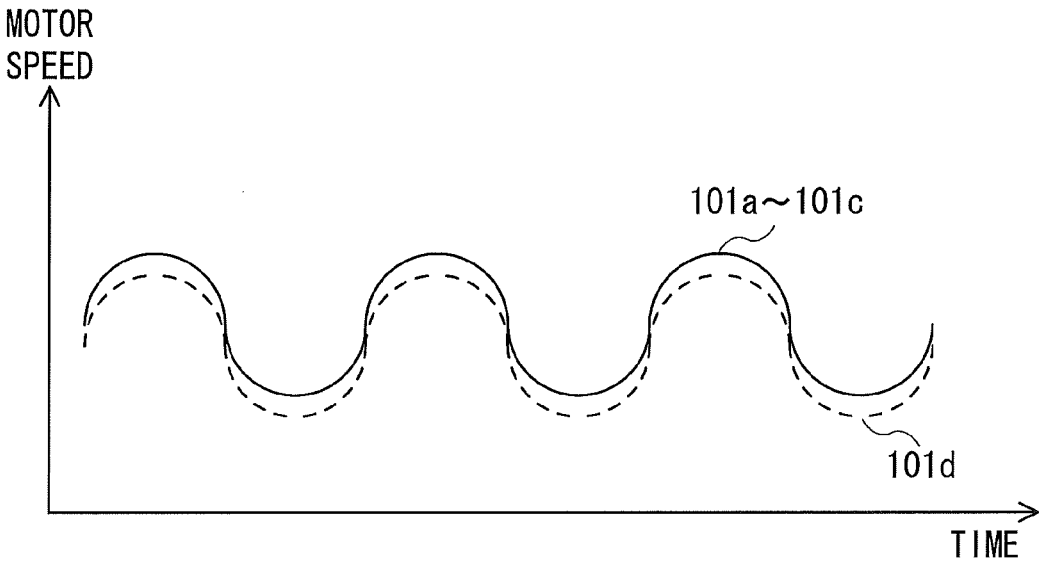
FIG. 4B is another explanatory diagram of the phase difference in rotation between the photosensitive drums.

FIGS. 4A and 4B are explanatory diagrams showing a phase difference in rotation between the photosensitive drums 101*a*, 101*b*, and 101*c*, and the photosensitive drum 101*d*. FIG. 4A shows a state where a phase shift is large, whereas FIG. 4B shows a state where the phase shift is small.

The photosensitive drums 101*a*, 101*b*, 101*c*, and 101*d* rotate in contact with the intermediate transfer belt 104 at the time of the image formation. The photosensitive drums 101*a*, 101*b*, 101*c*, and 101*d* and the intermediate transfer belt 104 are controlled so as not to generate an unnecessary friction at the startup and stop of the rotation. Therefore, the color motor 102*a* and the monochrome motor 102*d* are controlled precisely by the motor control unit 204 at the start and stop of the rotation. Thus, a large rotation phase shift is not generated between the photosensitive drums 101*a*, 101*b*, and 101*c* and the photosensitive drum 101*d* in the startup and the stop. However, the phase shifts are accumulated after the repetition of the startup and stop. As a result, the large phase shift is generated as shown in FIG. 4A.

When the phase shift is small as shown in FIG. 4B, a color deviation due to the rotation phase shift generated between the photosensitive drums 101*a*, 101*b*, and 101*c*, and the photosensitive drum 101*d* is reduced to a predetermined level or lower. However, when the phase shift is generated as shown in FIG. 4A, an unexpected large color deviation is generated due to the rotation phase shift generated between the photosensitive drums 101*a*, 101*b*, and 101*c* and the photosensitive drum 101*d*.

When an operation is performed in the black monochromatic mode, only the photosensitive drum 101*d* is rotated, whereas the photosensitive drums 101*a*, 101*b*, and 101*c* are held in a stopped state. Therefore, the relationship between the phase of the photosensitive drums 101*a*, 101*b*, and 101*c*, and the phase of the photosensitive drum 101*d* cannot be acquired. Thus, there is a possibility of generation of an extremely large color deviation in the next image formation. Even in the case where a jam of the recording medium P occurs and an urgent stop is made, the photosensitive drums 101*a*, 101*b*, 101*c*, and 101*d* are stopped in a state in which the relationship of the phases of the photosensitive drums 101*a*, 101*b*, and 101*c*, and the photosensitive drum 101*d* cannot be acquired. Thus, there is a possibility of generation of an extremely large color deviation in the next image formation. Therefore, it is effective to perform the phase registration of the photosensitive drums 101*a*, 101*b*, 101*c*, and 101*d* to form a high-quality image without a color deviation.

[Phase Registration]

Figure 5:
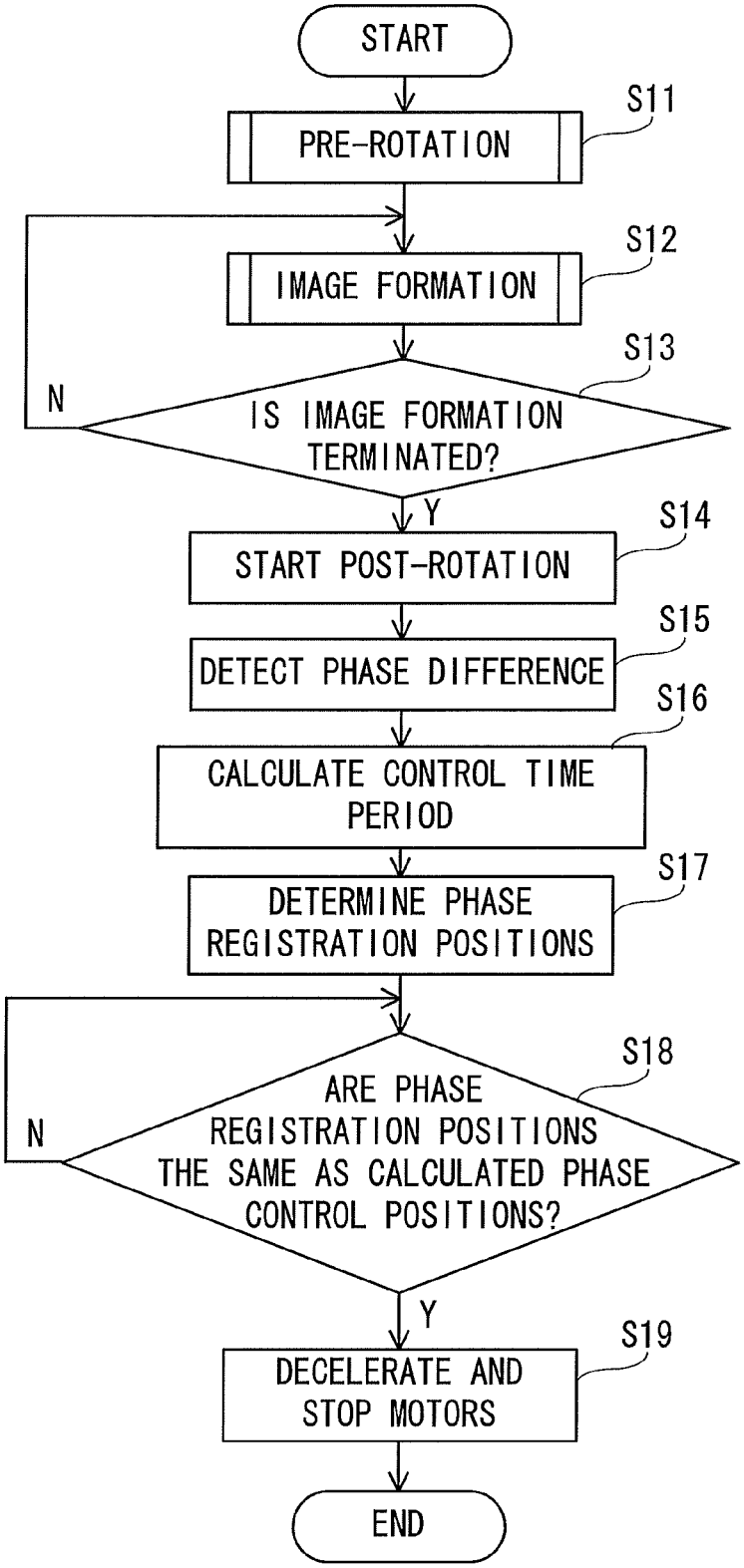
FIG. 5 is a flowchart illustrating a processing procedure of phase registration when photosensitive drums are stopped.

In this embodiment, phase registration is performed at the time of stop of the photosensitive drums 101*a*, 101*b*, 101*c*, and 101*d*. FIG. 5 is a flowchart illustrating a processing procedure of the phase registration.

In response to the reception of data of the print job from the host computer 208, the printer control unit 201 controls the motor 205 by the motor control unit 204 to activate the photosensitive drums 101*a*, 101*b*, 101*c*, and 101*d*, and the intermediate transfer belt 104. The printer control unit 201 controls the photosensitive drums 101*a*, 101*b*, 101*c*, and 101*d*, and the intermediate transfer belt 104 to perform a pre-rotation operation (startup process) so as to stably rotate the photosensitive drums 101*a*, 101*b*, 101*c*, and 101*d* at a target rotation speed (S11). If the phase registration is performed during the pre-rotation operation, the speed control operation is required to perform the phase registration before the start of image formation. As a result, it takes long time to start outputting a print. Therefore, in this embodiment, the phase registration is not performed during the pre-rotation operation, but is performed at the time of stop of the photosensitive drums.

After the pre-rotation operation, the printer control unit 201 performs the image formation in accordance with the print job (S12). After the image formation, the printer control unit 201 starts a post-rotation operation for post-processing such as image density adjustment (S13: Y and S14). After the post-processing, the printer control unit 201 detects a phase difference between the photosensitive drums 101*a* and 101*d* based on the results of detection by the phase detection sensors 103*a* and 103*d* (S15). The printer control unit 201 calculates a control time period required to register the phase of the photosensitive drum 101*a* and the phase of the photosensitive drum 101*d* with each other in accordance with the detected phase difference (S16).

If stop positions are set to the same positions for every stop in the phase registration performed at the time of stop of the photosensitive drums, the positions, at which the photosensitive drums 101*a*, 101*b*, 101*c*, and 101*d* are in contact with the intermediate transfer belt 104, are always the same in stop processing. Therefore, due to the friction generated in the stop processing, the degradation of portions of the photosensitive drums 101*a*, 101*b*, 101*c*, and 101*d* and the intermediate transfer belt 104, which are brought into contact with each other, is accelerated as compared with the other portions. Therefore, the printer control unit 201 determines the positions for the current phase registration so that the previous stop positions and the current stop positions of the photosensitive drums 101*a*, 101*b*, 101*c*, and 101*d* do not become the same. Then, based on the calculated control time period and the positions for phase registration, timing of stopping the motors for driving the respective photosensitive drums is determined. In this embodiment, timing of stopping the monochrome motor 102*d* and timing of stopping the color motor 102*a* are determined (S17).

The printer control unit 201 counts time from the acquisition of the detection signal by the phase detection sensor 103*a* and time from the acquisition of the detection signal by the phase detection sensor 103*d* so as to acquire the positions at which the photosensitive drums 101*a*, 101*b*, 101*c*, and 101*d* are in contact with the intermediate transfer belt 104. Then, when a count value from the acquisition of the detection signal by the phase detection sensor 103*a* becomes equal to a value corresponding to the timing of stopping the color motor 102*a*, which is determined in Step S17, the printer control unit 201 stops the color motor 102*a*. When the count value from the acquisition of the detection signal by the phase detection sensor 103*d* becomes equal to the value corresponding to the timing of stopping the monochrome motor 102*d*, which is determined in Step S17, the printer control unit 201 stops the monochrome motor 102*d* (S18: Y and S19). By the processing described above, the phase registration at the time of stop of the photosensitive drums 101*a*, 101*b*, 101*c*, and 101*d* is completed.

By the processing described above, the phases of the photosensitive drums 101*a*, 101*b*, 101*c*, and 101*d* can be registered at the time of stop of the photosensitive drums 101*a*, 101*b*, 101*c*, and 101*d*.

[Microscale Driving]

Figure 6:
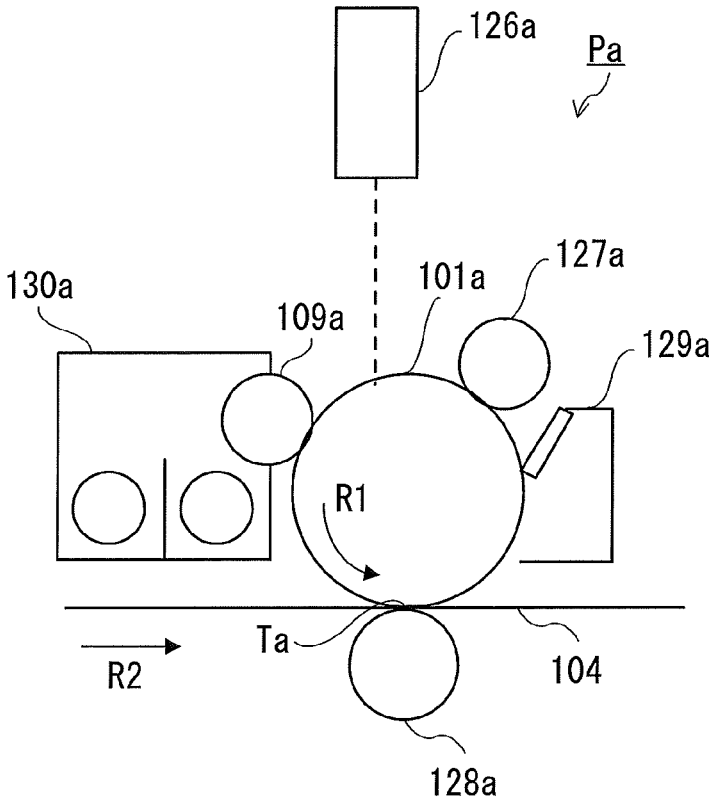
FIG. 6 is an explanatory view of a configuration of an image forming unit.

FIG. 6 is an explanatory view illustrating a configuration of the yellow image formation section Pa. The other image formation sections Pb, Pc, and Pd have the same configuration, and operate in the same manner. Therefore, only the image formation section Pa is described in this embodiment, and the description of the other image formation sections Pb, Pc, and Pd is herein omitted.

The image formation section Pa includes a charging roller 127*a*, the exposure section 126*a*, a development section 130*a*, a primary transfer roller 128*a*, and a cleaning section 129*a*, which are provided around the photosensitive drum 101*a*. The photosensitive drum 101*a* includes a photosensitive layer having a negative polarity as a charging polarity formed on an outer circumferential surface of an aluminum cylinder, and is rotated at a predetermined processing speed in a direction indicated by the arrow R1.

The charging roller 127*a* is held in contact with the photosensitive drum 101*a*, and is driven to rotate. By applying an oscillating voltage obtained by superimposing an A D voltage onto a DC voltage, the charging roller 127*a* charges a surface of the photosensitive drum 101*a* with a uniform dark-area potential VD having a negative polarity. The exposure section 126*a* emits a laser beam based on image data corresponding to yellow. The laser beam emitted from the exposure section 126*a* is deflected by a rotating polygon (not shown) to scan the photosensitive drum 101*a*. An electrostatic latent image is formed on the surface of the photosensitive drum 101*a*. The development section 130*a* develops the electrostatic latent image formed on the photosensitive drum 101*a* by using a yellow toner to generate a yellow toner image.

A primary transfer portion Ta is formed between the primary transfer roller 128*a* and the photosensitive drum 101*a*. The primary transfer roller 128*a* and the photosensitive drum 101*a* interpose the intermediate transfer belt 104 so as to press the intermediate transfer belt 104 therebetween. By the application of a DC voltage having a positive polarity to the primary transfer roller 128*a*, the toner image formed on the photosensitive drum 101*a* is primarily transferred to the intermediate transfer belt 104 which passes through the primary transfer portion Ta. The cleaning section 129*a* brings a cleaning blade into slide contact with the photosensitive drum 101*a* to collect a transfer residual toner remaining on the photosensitive drum 101*a* without being transferred to the intermediate transfer belt 104.

In the case where the photosensitive drum 101*a* remains undriven for a long time period, a residual toner (residual recording agent) between the photosensitive drum 101*a* and the cleaning blade sometimes firmly adheres to the surface of the photosensitive drum 101*a*. If the intermediate transfer belt 104 is pressed in a state in which the toner firmly adheres to the surface of the photosensitive drum 101*a*, a striped abnormal image, which is a defective image, is formed. By rotationally driving the photosensitive drum 101*a* for a predetermined number of revolutions or larger, the firmly adhering toner is removed by the cleaning blade. In order to remove the firmly adhering toner, the photosensitive drum 101*a* is required to be rotated for a predetermined number of revolutions. Therefore, waiting time for the start of the image formation operation is increased and productivity falls.

Therefore, after stopping the photosensitive drum 101*a* in accordance with the end of the image formation the microscale driving of the photosensitive drum 101*a* is performed at constant time intervals. In this manner, the toner is prevented from firmly adhering to the surface of the photosensitive drum 101*a*. The same is applied to the other photosensitive drums 101*b*, 101*c*, and 101*d*.

Figure 7:
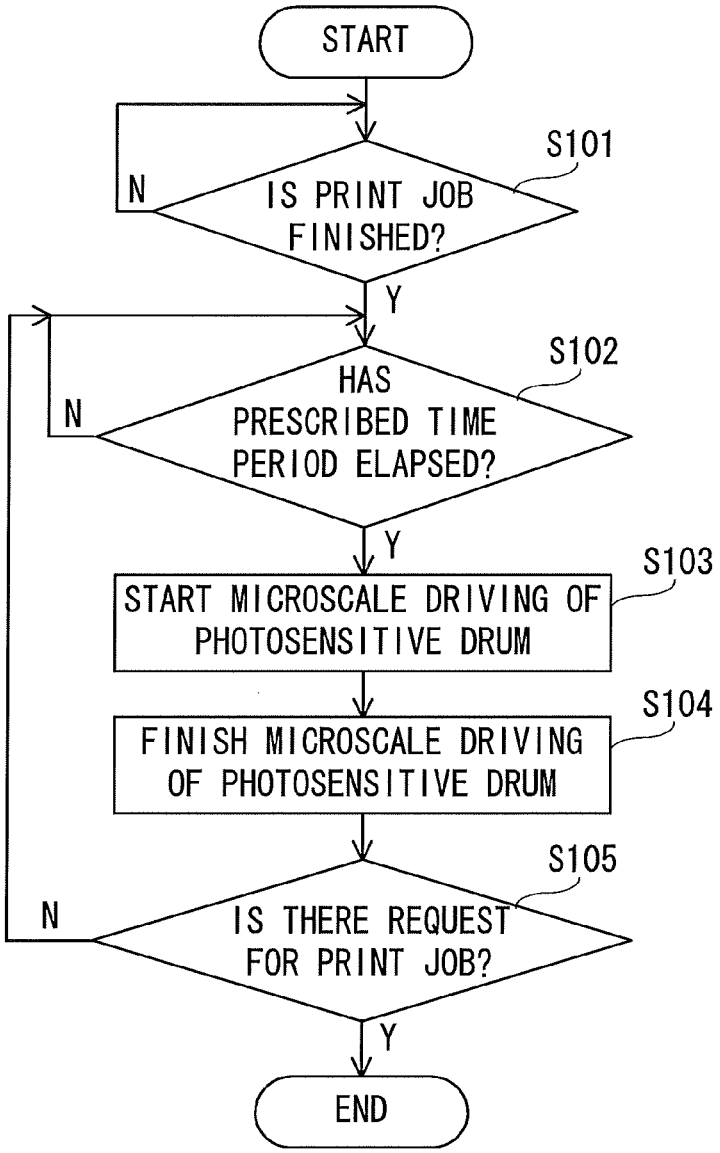
FIG. 7 is a flowchart of a processing procedure of a microscale driving operation.

FIG. 7 is a flowchart of a processing procedure of a microscale driving operation of the photosensitive drum 101*a*. Although the microscale driving operation of the photosensitive drum 101*a* is described as an example, the microscale driving operation is performed in the same processing even for the photosensitive drums 101*b*, 101*c*, and 101*d*.

The printer control unit 201 starts controlling the microscale driving operation of the photosensitive drum 101*a* after the print job is finished (S101: Y). The printer control unit 201 counts a time period after the end of the print job, and compares the counted time period with a predetermined time period (prescribed time period) (S102). When the counted time period is equal to or longer than the prescribed time period (S102: Y), the printer control unit 201 starts the microscale driving of the photosensitive drum 101*a* from a time point at which the counted time period becomes equal to the prescribed time period as a point of origin, and resets the counted time period (S103). After the microscale driving is performed for a predetermined time period, the printer control unit 201 terminates the microscale driving of the photosensitive drum 101*a* (S104). After the microscale driving is terminated, the printer control unit 201 verifies whether or not there is another print job. When there is another print job, the control over the microscale driving operation of the photosensitive drum 101*a* is terminated (S105: Y). Then, the print job is executed. On the other hand, when there is no print job, the processing returns to Step S102 (S105: N).

The photosensitive drum 101*a* and the cleaning blade are brought into abutment with each other to slide against each other. Therefore, a time period in which the photosensitive drum 101*a* and the cleaning blade slide against each other affects a lifetime of the parts. Specifically, when the amount of rotation of the photosensitive drum 101*a* is set as small as possible, the lifetime of the parts is prolonged, which leads to reduction of running cost of the image forming apparatus 100. Therefore, it is desirable to reduce the amount of rotation by the microscale driving as small as possible.

In this embodiment, the microscale driving is repeated at prescribed time intervals after the end of the image formation. Therefore, even when the phase registration is performed between the photosensitive drums 101*a*, 101*b*, 101*c*, and 101*d* when the photosensitive drums 101*a*, 101*b*, 101*c*, and 101*d* are stopped after the end of the image formation, a phase shift (phase-difference) is generated between the rotation phases of the photosensitive drums. If the photosensitive drums are activated in this state, the phases registration is required at the time of activation of the photosensitive drums. As a result, time required to start outputting a print becomes disadvantageously longer.

The brushless motor outputs a pulses signal (FG signal) in accordance with a rotation speed thereof. By counting the pulse signal, the drive amount of the motor can be detected without additionally using a rotation detector. Specifically, each of the drive amount of the color motor 102*a* and the drive amount of the monochrome motor 102*d* can be detected by the count value of the pulse signal (FG signal) of the brushless motor. By detecting the drive amount of the color motor 102*a* and the drive amount of the monochrome motor 102*d*, the phases of the photosensitive drums 101*a*, 101*b*, 101*c*, and 101*d* can be detected.

Figure 8:
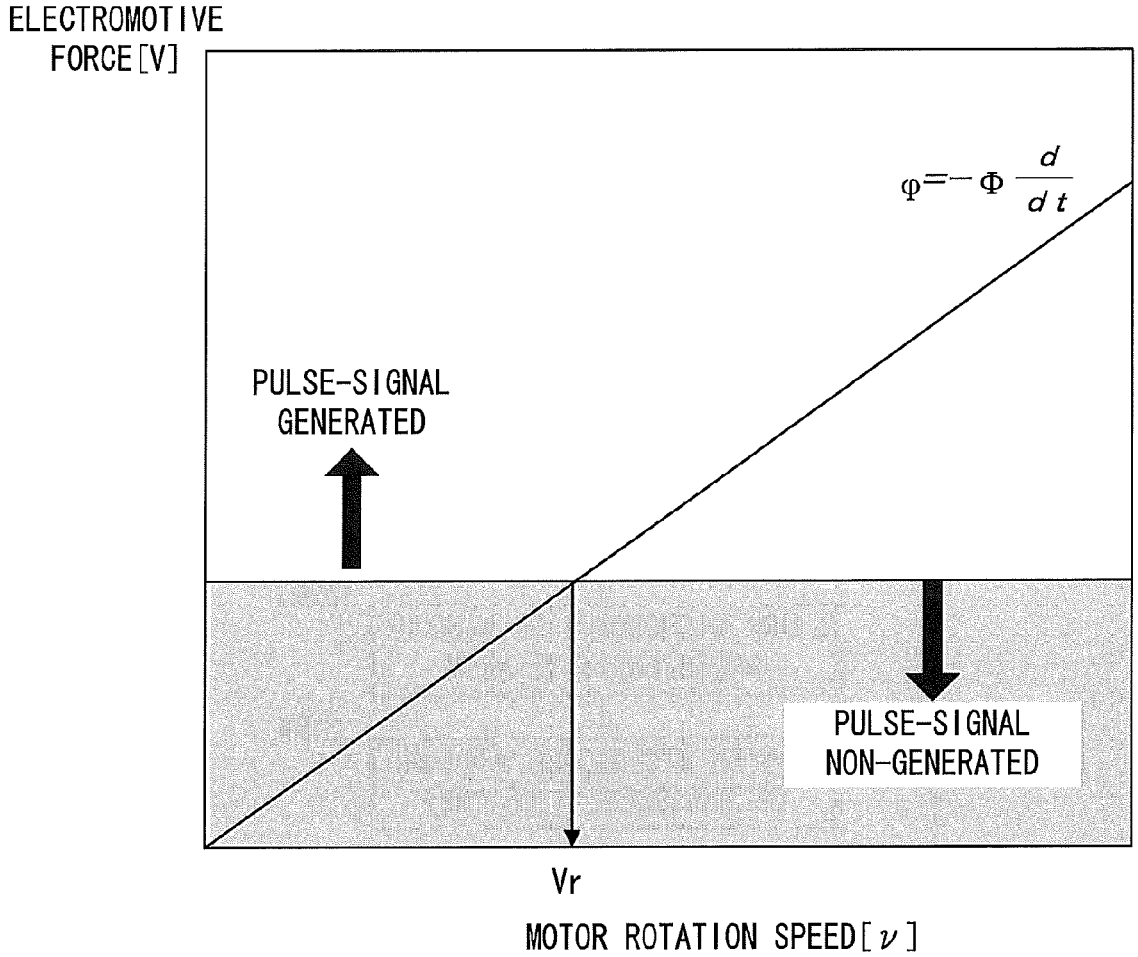
FIG. 8 is a correlation diagram of a rotation speed of a brushless motor and an electromotive force.

In order to reduce the slide of the photosensitive drums 101*a*, 101*b*, 101*c*, and 101*d* as described above, it is desirable to rotate the motor at a low speed and count the pulse signal. As illustrated in FIG. 8, however, the pulse signal of the brushless motor is output only after the rotation speed becomes equal to a prescribed rotation speed, for example, 600 [rpm] or higher. Therefore, it is difficult to detect the drive amount of the photosensitive drum by the pulse signal while performing the microscale driving of the photosensitive drum at the low speed.

[Image Formation Processing]

Figure 9:
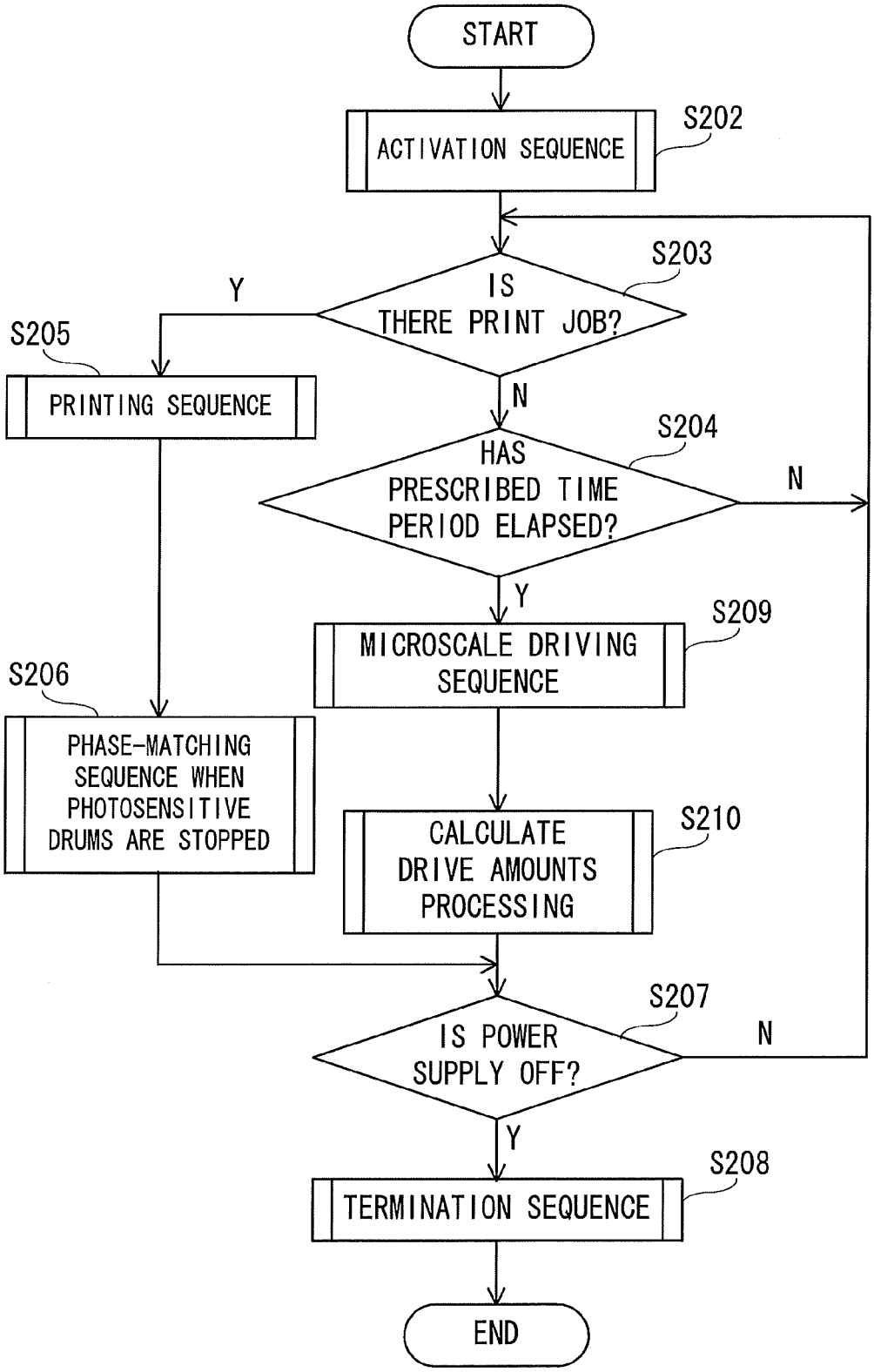
FIG. 9 is a flowchart illustrating a processing procedure of image formation processing.

FIG. 9 is a flowchart illustrating a processing procedure of image formation processing performed by the printer control unit 201 of the image forming apparatus 100 according to this embodiment.

The printer control unit 201 starts the processing illustrated in FIG. 9 when the power supply 202 of the image forming apparatus 100 is turned ON. First, the printer control unit 201 executes an activation sequence (S202). In the activation sequence, adjustments of the respective components, which are required to perform a printing operation such as rising a temperature of the fixing section 107 to a desired temperature, are performed. After the end of the activation sequence, a state of the image forming apparatus 100 transitions to a standby state in which a print job for a print or a copy is accepted. The image forming apparatus 100 in the standby state determines whether or not there is a print job (S203). When there is the print job, the printer control unit 201 executes a printing sequence based on the print job (S203: Y and S205). The printing sequence in Step S205 corresponds to the processing in Steps S11 to S13 illustrated in FIG. 5. After the end of the printing sequence, the phase registration processing at the time of stop of the photosensitive drums is executed (S206). A phase registration sequence performed at the time of stop of the photosensitive drums corresponds to the processing in Steps S14 to S19 illustrated in FIG. 5. When the power supply 202 is not turned OFF after the end of the phase registration, the image forming apparatus 100 returns to the standby state (S207: N and S203). When the power supply 202 is turned OFF, a termination sequence is performed to terminate the processing (S207: Y and S208).

In the standby state, the printer control unit 201 determines whether or not a prescribed time period has elapsed from the end of the previous operation (S204). The previous operation is the execution of the print job or the microscale driving sequence. The prescribed time period differs depending on the photosensitive drums to be used, the toner, the configuration of the image forming apparatus, and the environment, and is set arbitrarily. In this case, the prescribed time period is set to 20 minutes as an example.

When there is no print job and the prescribed time period has elapsed, the printer control unit 201 executes the microscale driving sequence (S204: Y and S209). After the execution of the microscale driving sequence, the printer control unit 201 performs drive-amount calculation processing (S210). The details of the microscale driving sequence and the drive-amount calculation processing are described later. When the power supply 202 is not turned OFF after the end of the drive-amount calculation processing, the printer control unit 201 returns to the standby state (S207: N and S203). When the power supply 202 is turned OFF, the termination sequence is performed to terminate the processing (S207: Y and S208).

When there is no print job as described above, the image forming apparatus 100 repeats the microscale driving sequence at prescribed time intervals.

Figure 10:
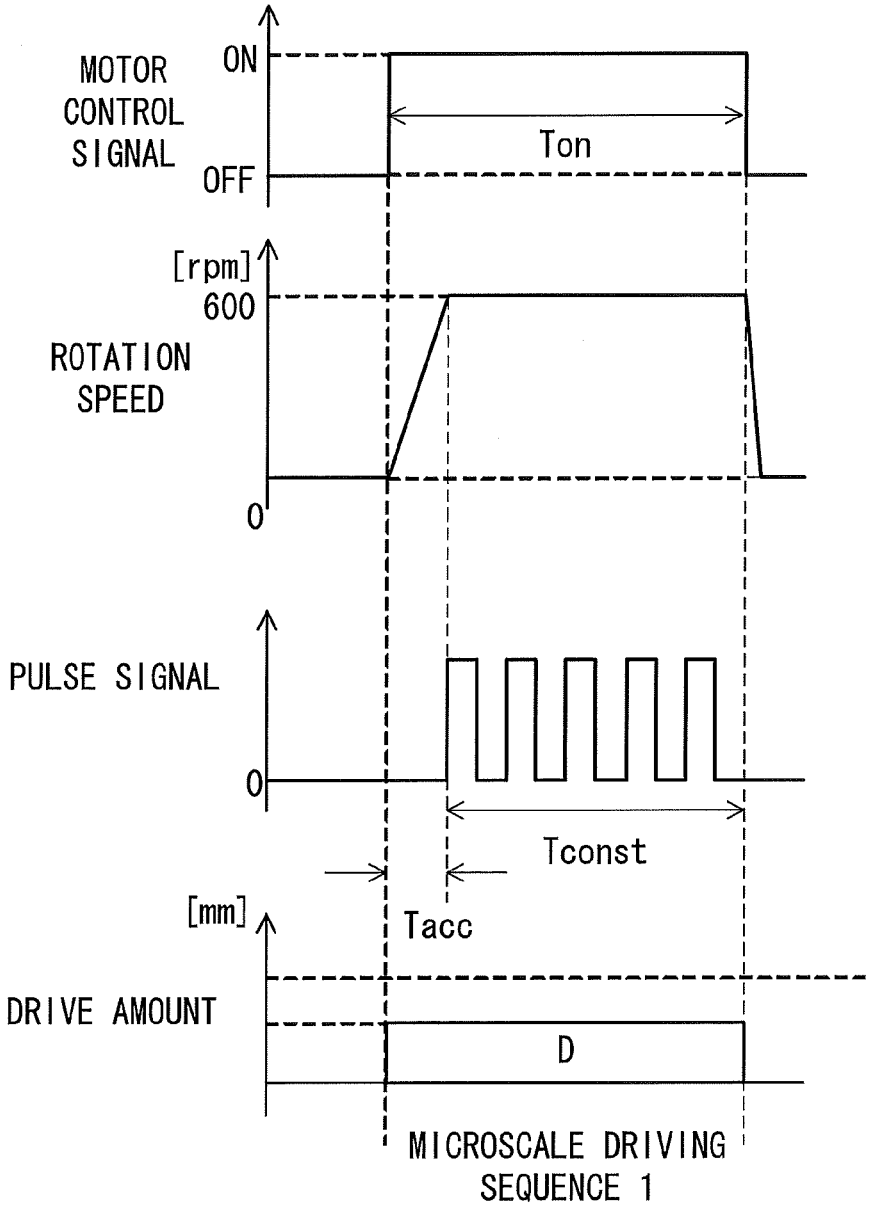
FIG. 10 is a timing chart showing the relationship between a motor control signal, a rotation speed of the motor, a pulse signal, and a motor drive amount at the time when a microscale driving sequence is executed.

Referring to FIG. 10, the microscale driving sequence (S209) and the drive-amount calculation processing (S210) are described. FIG. 10 is a timing chart showing the relationship between the motor control signal, the rotation speed of the motor, the pulse signal (FG signal), and the motor drive amount at the time of execution of the microscale driving sequence. In the microscale driving sequence, the monochrome motor 102*d* and the color motor 102*a* are driven for a constant microscale driving time period Ton. Although a target rotation speed of each of the monochrome motor 102*d* and the color motor 102*a* during the printing operation is about 2,400 [rpm], a target rotation speed in the microscale driving sequence is lower than that during the printing operation, that is, 600 [rpm].

For the detection of the rotation speed of the brushless motor, an FG-system detection section using an electromotive force generated during the rotation of the motor is generally used. The FG-system detection section includes magnetized magnets provided on a circumference of a rotor of the motor. A predetermined conductive pattern is provided so as to be opposed to magnetized surfaces of the magnetized magnets on a substrate on which the rotor is mounted. Along with the rotation of the rotor, the magnetized magnets also rotate. Therefore, the electromotive force due to electromagnetic induction is generated in the conductive pattern formed on the substrate. From the pulse signal (FG signal) in accordance with the electromotive force, the rotation speed of the motor can be detected. The pulse signal is output in accordance with the electromotive force generated during the rotation. Therefore, when the electromotive force is lower than a certain value, that is, an rpm is small, the pulse signal is not output. Thus, the pulse signal cannot be detected unless the motor is driven at a speed equal to or higher than a predetermined rotation speed. It takes time to accelerate the rotation speed of the motor to the target rotation speed and stop the rotation of the motor.

In the microscale driving sequence, it is desirable that the pulse signal be detectable while the drive amount in the microscale driving is reduced as small as possible, as described above. In this regard, it is preferred that the target rotation speed be as low as possible so that the pulse signal can be stably detected and the time to the stop of the motor can be reduced. Therefore, in this embodiment, the target rotation speed which satisfies the above-mentioned conditions is set to 600 [rpm]. However, the target rotation speed is not limited to the above-mentioned speed, and may be set in accordance with a range where the pulse signal of the used motor can be output. When the motor control signal is switched ON to activate the motor, the rotation speed of the motor is accelerated to the target rotation speed at which the output of the pulse signal is started.

It is assumed that an acceleration time period from the activation of the motor to the achievement of the target rotation speed is Tacc and a constant-speed time period in which the motor is driven at the target rotation speed after the acceleration time period is Tconst. Then, a microscale driving time period Ton corresponding to a whole time period of the microscale driving sequence is constant. Therefore, Tconst=Ton−Tacc is established. After the elapse of the microscale driving time period Ton, the motors are stopped. The motors are stopped by braking with a short brake. Therefore, a drive amount by load inertia after the motor control signal is switched OFF can be ignored. Moreover, the target rotation speed is lower than the general rotation sped 2,400 [rpm]. Therefore, the effect of the load inertia on the photosensitive drums 101*a* to 101*d* is small. A drive amount D in the microscale driving sequence is expressed by the sum of a drive amount Dacc during the acceleration time period Tacc and a drive amount Dconst during the constant-speed time period Tconst.

The acceleration time period Tacc is a time period from the activation of the motors to the achievement of a frequency corresponding to the rotation speed of 600 [rpm]. The acceleration time period Tacc can be obtained by measuring a time period from the output of the motor control signal Ton to the detection of the pulse signal. In general, an rpm at which the output of the pulse signal is started is not fixed due to individual variability between the motors. Therefore, in this embodiment, the lowest rotation speed which ensures the output of the pulse signal is set as the target rotation speed. In practice, the output of the pulse signal is started at 500 [rpm] which is lower than 600 [rpm]. However, a time period to the achievement of the rotation speed of 600 [rpm] corresponds to the acceleration time period Tacc.

The reason why the frequency corresponding to 600 [rpm] is used is because the motor rpm and the frequency at which the output of the pulse signal is started generally have the relationship: (frequency of pulse signal)=(motor rpm)×A (A is 45/60, for example).

Based on the assumption that the acceleration from the activation to the target rotation speed is linear as illustrated in FIG. 10, the drive amount Dacc during the acceleration time period Tacc is obtained from an area of a triangle having the acceleration time period Tacc as a base and the target rotation speed of 600 [rpm] as a height. Specifically, the drive amount Dacc=Tacc×600 (target rotation speed)×0.5 is established. The constant-speed time period Tconst is calculated by: Tconst=Ton−Tacc. The drive amount Dconst during the constant-speed time period Tconst is calculated from an area of a rectangle, that is, Dconst=Tconst−600 (target rotation speed).

The drive amount D in the microscale driving sequence is obtained as: D=Dacc+Dconst. The drive amount D in the single microscale driving sequence can be calculated by using the expression described above. A cumulative drive amount when the microscale driving sequence is successively executed for N times (N is a natural number) is obtained by: DN=D1+D2+ . . . +Dn−1+Dn.

In this embodiment, the processing for calculating the cumulative drive amount DN of the single motor has been described. In practice, however, the above-mentioned processing is performed for each of the monochrome motor 102*d* and the color motor 102*a*. The cumulative drive amount DN cumulatively increases as the number of times of execution of the microscale driving sequence increases. However, when the printing sequence is performed, the phase registration subsequent to the end of the print job is performed. Therefore, the cumulative drive amount DN is reset.

Figure 11:
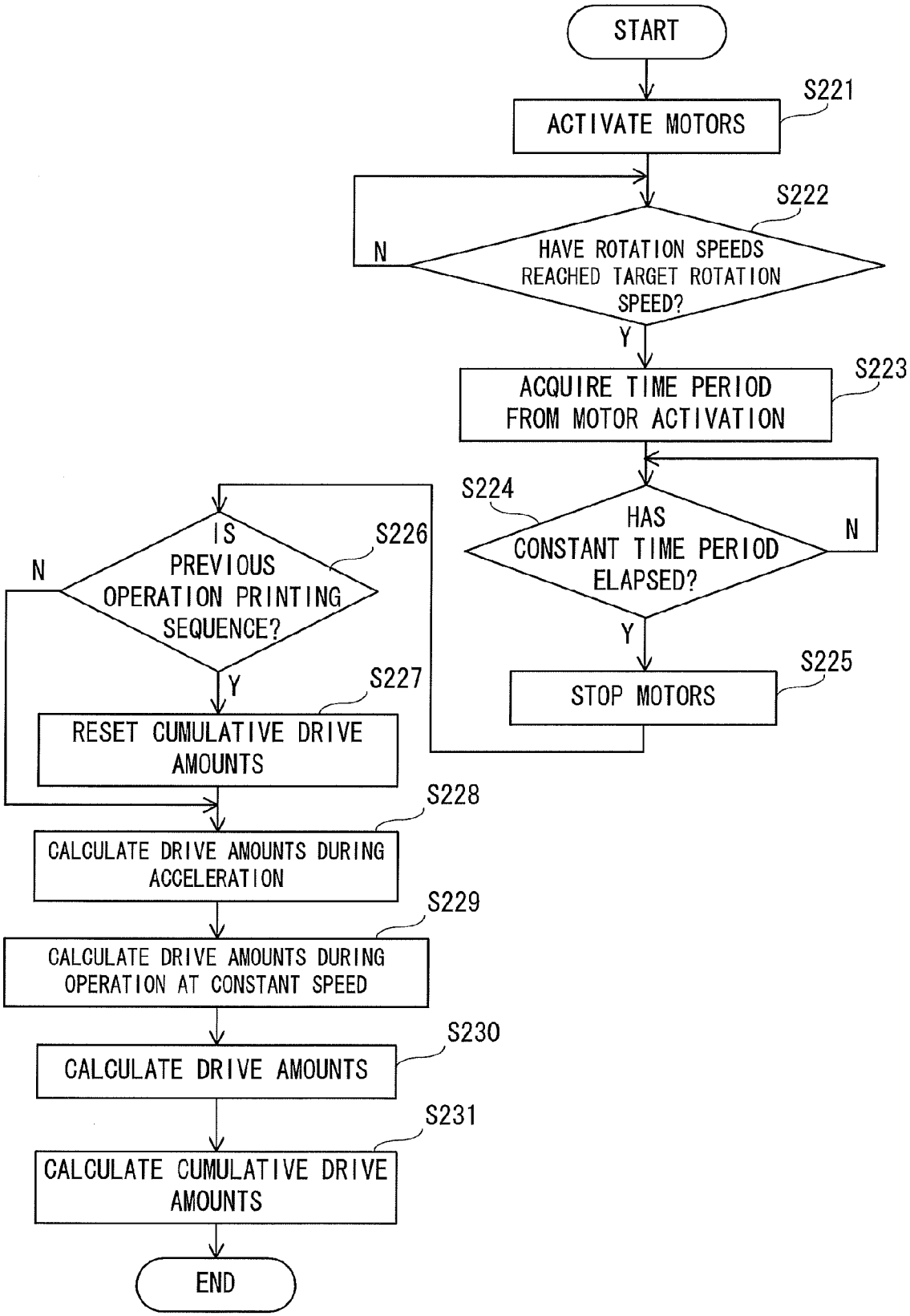
FIG. 11 is a flowchart illustrating a processing procedure of the microscale driving sequence and processing for calculating a drive amount.

FIG. 11 is a flowchart illustrating a processing procedure of the microscale driving sequence (S209) and the processing for calculating the drive amount (S210).

In the microscale driving sequence, the printer control unit 201 first inputs the motor control signal indicating an ON state to the motor control unit 204. The motor control unit 204 activates the color motor 102*a* and the monochrome motor 102*d* by using the motor control signal (S221). The printer control unit 201 monitors whether or not the rotation speeds of the color motor 102*a* and the monochrome motor 102*d* have reached the target rotation speed (S222). Specifically, the printer control unit 201 determines whether or not the pulse signals (FG signals) of the color motor 102*a* and the monochrome motor 102*d* are successfully detected.

After the rotation speeds reach the target rotation speed, the printer control unit 201 acquires a time period (acceleration time period Tacc) from the turn-ON of the motor control signal to the achievement of the target rotation speed of the color motor 102*a* and the monochrome motor 102*d* (S222: Y and S223). Specifically, the printer control unit 201 measures a time period from the start of the ON state of the motor control signal to the detection of the pulse signals.

After the rotation speeds of the color motor 102*a* and the monochrome motor 102*d* reach the target rotation speed, the color motor 102*a* and the monochrome motor 102*d* are constantly driven at the target rotation speed. After the time period from the start of the ON state of the motor control signal becomes equal to the microscale driving time period Ton, the printer control unit 201 stops each of the color motor 102*a* and the monochrome motor 102*d* by the brake (S224: Y and S225). The processing up to this step corresponds to the microscale driving sequence.

After the end of the microscale driving sequence, the printer control unit 201 calculates the drive amount of each of the motors during the microscale driving sequence. For the calculation of the drive amount, the printer control unit 201 determines whether or not the previous operation of the image forming apparatus 100 is the printing sequence (S226). When the previous operation is the printing sequence, the phase registration between the color motor 102*a* and the monochrome motor 102*d* has already been performed. Therefore, the cumulative drive amounts DN are reset to zero (S226: Y and S227). When the previous operation is not the printing sequence, the microscale driving sequence has been executed as the previous operation. Therefore, the cumulative drive amounts DN are not reset (S226: N).

The printer control unit 201 uses the following expression to calculate the drive amount Dacc during the acceleration and the drive amount Dconst during the operation at the constant speed (S228 and S229).

$$Dacc=Tacc\times 600(\text{target rotation speed})\times 0.5$$

$$Dconst=Tconst\times 600(\text{target rotation speed})$$

The printer control unit 201 calculates the drive amount Dconst during the microscale driving sequence from the drive amount Dacc during the acceleration and the drive amount D during the operation at the constant speed (S230).

$$D=Dacc+Dconst$$

The printer control unit 201 adds the calculated drive amount D during the current microscale driving sequence to the cumulative drive amount DN to update the cumulative drive amount DN (S231).

The cumulative drive amount DN is individually calculated for each of the color motor 102*a* and the monochrome motor 102*d*. The processing up to this step is the drive-amount calculation processing.

Figure 12:
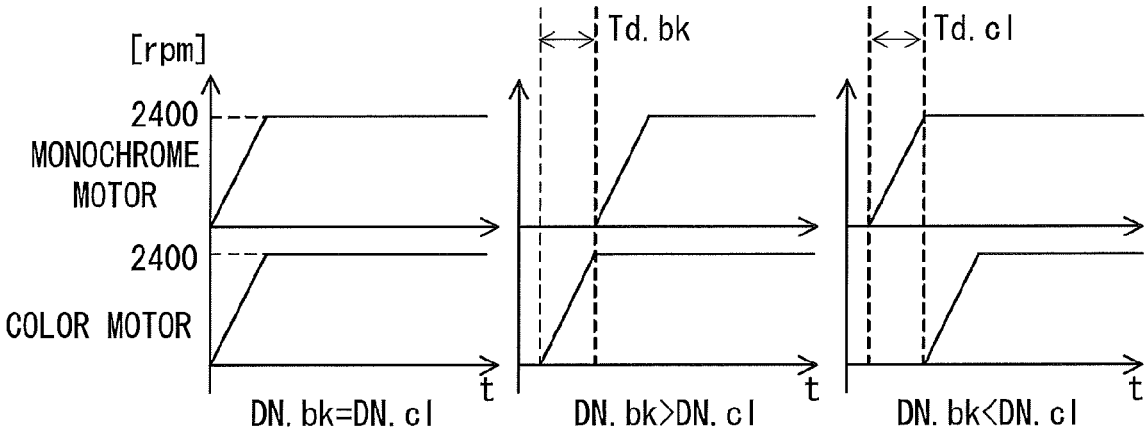
FIG. 12 is a timing chart showing the relationship between cumulative drive amounts and activation timing.

Activation-timing control processing using the cumulative drive amounts at the start of the printing sequence is described. FIG. 12 is a timing chart illustrating the relationship between the cumulative drive amount of the monochrome motor 102*d* and the cumulative drive amount of the color motor 102*a* and activation timing control.

The cumulative drive amount of the monochrome motor 102*d* and the cumulative drive amount of the color motor 102*a* after the microscale driving sequence is successively executed for N times are referred to respectively as a cumulative drive amount DN.bk and a cumulative drive amount DN.cl. The driving time period of the monochrome motor 102*d* and the driving time period of the color motor 102*a* in the microscale driving sequence are equal to each other. Therefore, ideally, the two cumulative drive amounts DN.bk and DN.cl become equal to each other. Specifically, ideally, DN.bk=DN.cl is satisfied. In practice, however, driving conditions differ for the monochrome motor 102*d* and the color motor 102*a* due to individual variability and a difference in load conditions. Therefore, as the number of times of execution of the microscale driving sequence increases, a difference between the cumulative drive amount DN.bk and the cumulative drive amount DN.cl becomes larger. The difference between the cumulative drive amount DN.bk and the cumulative drive amount DN.cl described above appears as a phase difference between the monochrome motor 102*d* and the color motor 102*a*. Thus, the activation timing of the monochrome motor 102*d* and the activation timing of the color motor 102*a* are required to be determined in accordance with the difference between the cumulative drive amount DN.bk and the cumulative drive amount DN.cl.

When there is no difference between the cumulative drive amount DN.bk and the cumulative drive amount DN.cl (DN.bk=DN.cl), the phase difference between the monochrome motor 102*d* and the color motor 102*a* is zero when the monochrome motor 102*d* and the color motor 102*a* are in the stopped state. Therefore, the monochrome motor 102*d* and the color motor 102*a* are activated simultaneously.

When the cumulative drive amount DN.bk is larger than the cumulative drive amount DN.cl (DN.bk>DN.cl), the phase of the monochrome motor 102*d* advances from the phase of the color motor 102*a*. Therefore, the activation of the monochrome motor 102*d* is delayed by a delay time period Td.bk from the activation of the color motor 102*a*. The delay time period Td.bk is calculated based on a difference ΔD between the cumulative drive amounts, ΔD=DN.bk−DN.cl. As the difference ΔD becomes larger, the delay time period Td.bk increases.

When the cumulative drive amount DN.bk is smaller than the cumulative drive amount DN.cl (DN.bk<DN.cl), the phase of the color motor 102*a* advances from the phase of the monochrome motor 102*d*. Therefore, the activation of the color motor 102*a* is delayed by a delay time period Td.cl from the activation of the monochrome motor 102*d*. The delay time period Td.cl is calculated based on the difference ΔD between the cumulative drive amounts, ΔD=DN.cl−DN.bk. As the difference ΔD becomes larger, the delay time period Td.cl increases.

As described above, by shifting the activation of the monochrome motor 102*d* by the delay time period Td.bk or the activation of the color motor 102*a* by the delay time period Td.cl, the phase registration between the monochrome motor 102*d* and the color motor 102*a* can be achieved.

Figure 13:
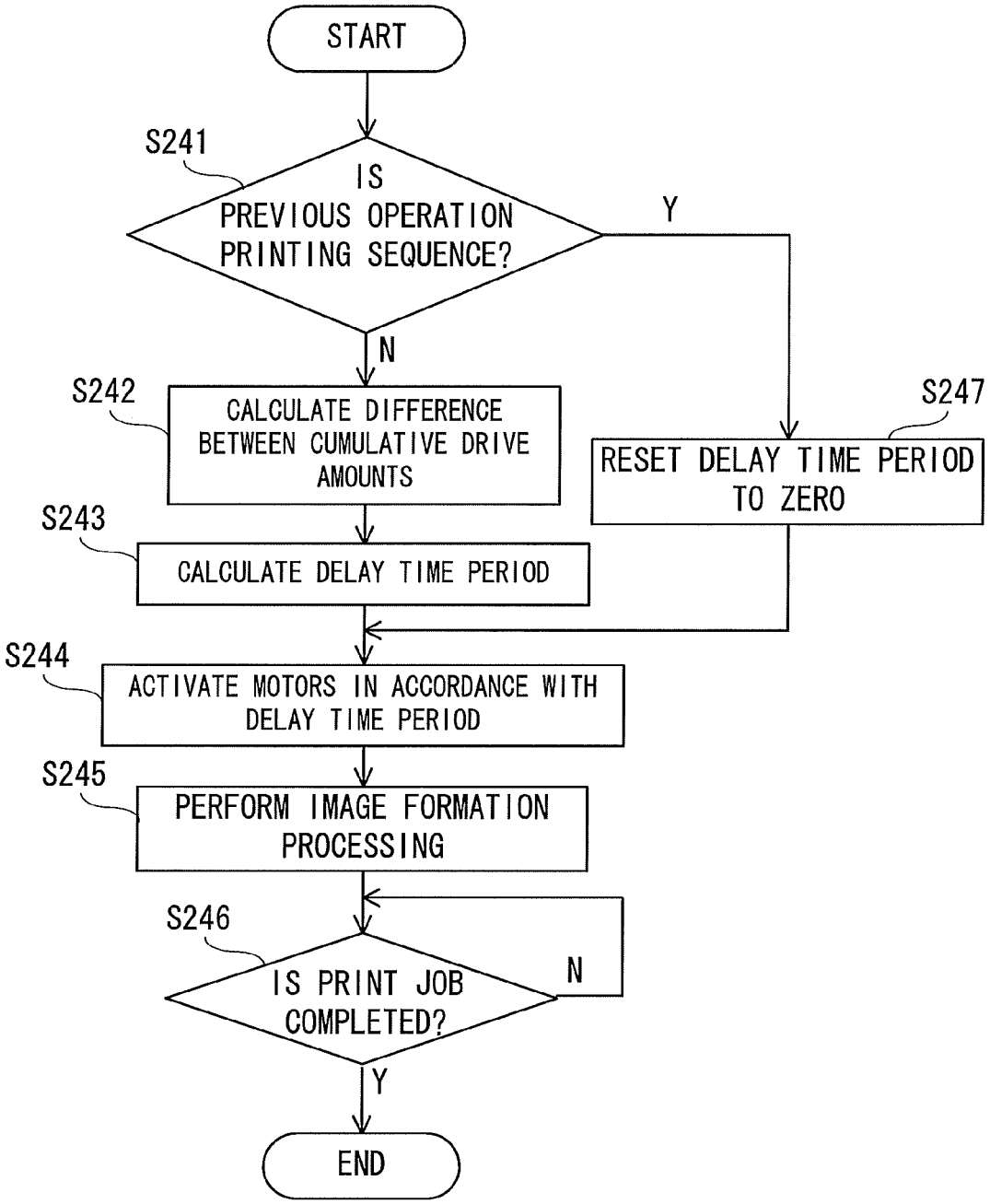
FIG. 13 is a flowchart illustrating processing of an activation sequence at the start of a printing sequence.

FIG. 13 is a flowchart illustrating activation sequence processing at the start of the printing sequence (S11 illustrated in FIG. 5 and S205 illustrated in FIG. 9).

The printer control unit 201 determines whether or not the previous operation of the image forming apparatus 100 is the printing sequence (S241). When the previous operation is the printing sequence, the phase of the color motor 102*a* and the phase of the monochrome motor 102*d* are registered with each other by the phase registration performed after the printing sequence. Therefore, the printer control unit 201 is not required to adjust the activation timing, and sets the delay time periods Td.bk and Td.cl to zero (S241: Y and S247).

When the previous operation is the microscale driving sequence, the printer control unit 201 calculates the difference ΔD between the cumulative drive amounts DN.bk and DN.cl (S241: N and S242). The printer control unit 201 calculates the delay time period Td.bk or Td.cl from the difference ΔD based on the magnitude relationship between the cumulative drive amounts DN.bk and DN.cl (S243). As described above, when the previous operation is the microscale driving sequence, the delay time period Td.bk or Td.cl is calculated.

The printer control unit 201 adjusts the activation timing of the monochrome motor 102*d* or the color motor 102*a* in accordance with the delay time period Td.bk or Td.cl and then activates the monochrome motor 102*d* and the color motor 102*a* (S244). The printer control unit 201 performs the image formation after the activation of the monochrome motor 102*d* and the color motor 102*a*. By the termination of the image formation, the printer control unit 201 terminates the print job (S245 and S246: Y).

In this embodiment, the activation timing of the monochrome motor 102*d* or the color motor 102*a* is adjusted based on the difference ΔD between the cumulative drive amounts DN.bk and DN.cl so that the phases of the monochrome motor 102*d* and the color motor 102*a* are registered with each other. When the number of the drive motors is larger, the activation timing of each of the drive motors is adjusted in accordance with a variation in the cumulative drive amount between the drive motors so as to reduce the variation.

The operation described above is a simultaneous operation of the monochrome motor 102*d* and the color motor 102*a*, that is, an operation in a color printing mode. In the monochrome printing mode, only the monochrome motor 102*d* is driven without driving the color motor 102*a*.

In the case of the operation in the monochrome printing mode, the monochrome motor 102*d* is activated in the printing sequence. On the other hand, the microscale driving of the color motor 102*a* is continuously performed at the constant time intervals. Therefore, the activation timing control in Steps S241 to S244 illustrated in FIG. 13 at the start of the printing sequence is not required. Thus, the monochrome motor 102*d* is activated without the phase registration. After the termination of the printing sequence in the monochrome printing mode, the phase registration is performed.

In the case of the operation in the color printing mode, both the monochrome motor 102*d* and the color motor 102*a* are driven after the termination of the printing sequence. Therefore, the phase registration (processing in Steps S14 to S19 illustrated in FIG. 5) is executed based on the results of detection by the respective phase detection sensors 103*a* and 103*b*.

During the phase registration after the termination of the printing sequence in the monochrome printing mode, the color motor 102*a* is in the stopped state. In a plurality of time sections in the printing sequence, the color motor 102*a* continues the microscale driving. Therefore, a position at which the monochrome motor 102*d* is to be stopped is determined based on the cumulative drive amount DN.cl of the color motor 102*a* and the phase registration position (S17 illustrated in FIG. 5) determined after the termination of the previous printing sequence in the color printing mode. Then, the monochrome motor 102*d* is stopped at the determined position. In this manner, the phase registration between the monochrome motor 102*d* and the color motor 102*a* can be achieved.

Figure 14:
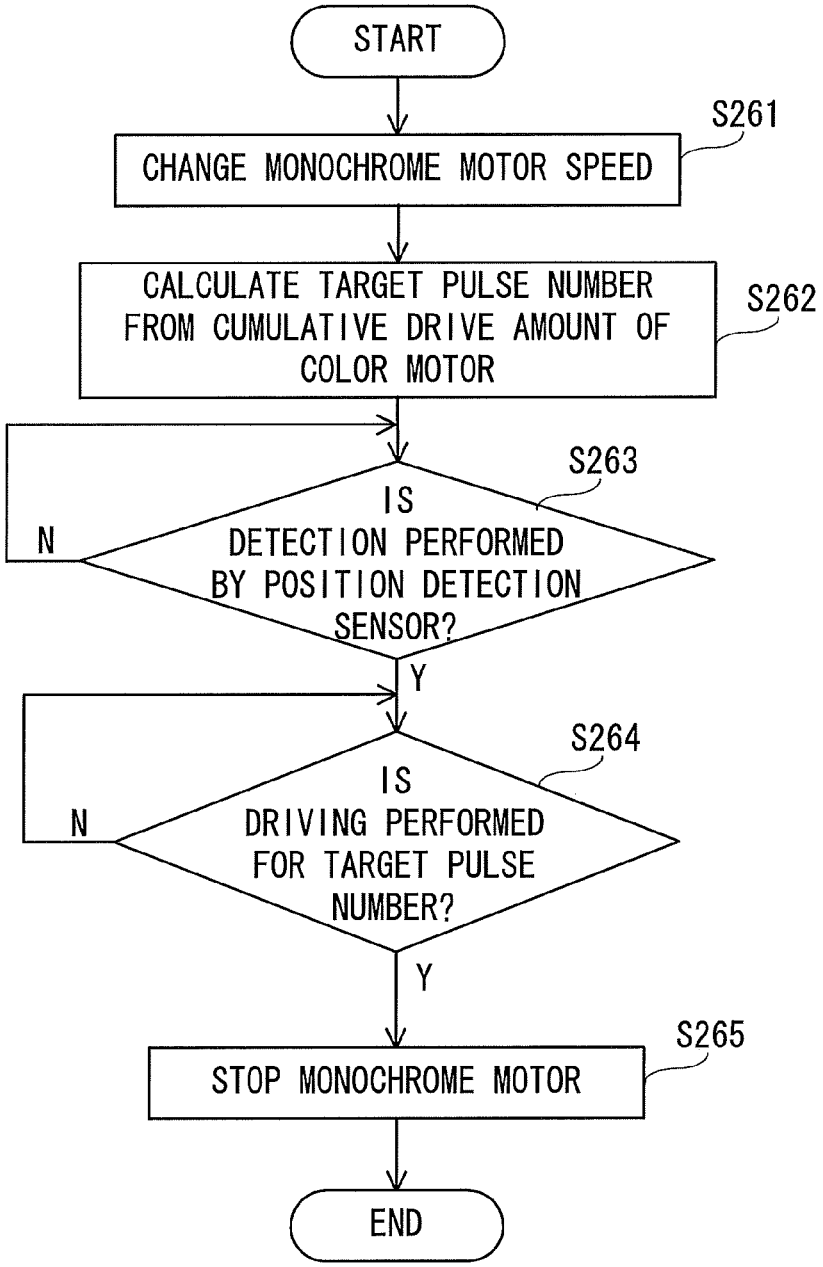
FIG. 14 is a flowchart illustrating phase registration processing after the end of the printing sequence in a monochrome printing mode.

FIG. 14 is a flowchart illustrating the phase registration processing (S14 to S19 illustrated in FIG. 5 and S206 illustrated in FIG. 9) after the termination of the printing sequence in the monochrome printing mode. In this case, the monochrome motor 102*d* performs an operation for the printing job, whereas the microscale driving of the color motor 102*a* is performed. When the number of the drive motors is three or larger, one of the drive motors performs the print job, whereas the microscale driving is performed for the remaining drive motor(s).

The printer control unit 201 changes the rotation speed of the monochrome motor 102*d* after the termination of the printing sequence in the monochrome printing mode (S261). It is desirable to set the rotation speed low so as to reduce the effect of the load inertia generated when the monochrome motor 102*d* is stopped. However, the rotation speed of the monochrome motor 102*d* is required to be set as high as the rotation speed at which the pulse (FG) signal is output so as to control the drive amount by the pulse number. Therefore, in this embodiment, the rotation speed of the monochrome motor 102*d* is changed to the target rotation speed during the microscale driving sequence.

Subsequently, the printer control unit 201 determines the position at which the monochrome motor 102*d* is to be stopped based on the cumulative drive amount DN.cl of the color motor 102*a* and the phase registration position (S17 illustrated in FIG. 5) determined after the termination of the previous printing sequence in the color printing mode. Specifically, a target pulse number P which is the pulse number of the pulse (FG) signal to register the position at which the monochrome motor 102*d* is stopped with the phase of the color motor 102*a* is calculated (S262).

The printer control unit 201 monitors the phase detection sensor 103*d*, and drives the monochrome motor 102*d* by the target pulse number P after the detection of a reference position by the phase detection sensor 103*d* (S263: Y and S264). After driving the monochrome motor 102*d* by the target pulse number P, the printer control unit 201 stops the monochrome motor 102*d* by the brake (S264: Y and S265).

By the processing described above, the monochrome motor 102*d* and the color motor 102*a* are stopped with the phases being registered each other.

Alternatively, in place of the target pulse number P, a detection time period by the phase detection sensor 103*d* may be set as a target time period based on the cumulative drive amount and the rotation speed of the monochrome motor 102*d* so that the monochrome motor 102*d* is stopped after elapse of the target time period.

In the embodiment described above, the microscale driving time period Ton of the monochrome motor 102*d* and the color motor 102*a* during the execution of the microscale driving sequence is set constant. Even over the constant time period, however, the drive amount of the monochrome motor 102*d* and the drive amount of the color motor 102*a* differ from each other in some cases. For example, even when the same component is selected as the monochrome motor 102*d* and the color motor 102*a*, there is a low possibility that loads thereon become equal to each other. Even if the loads are equal to each other, there is a variation in characteristics. Therefore, there is a low possibility that the drive amounts become equal to each other. The possibility becomes further lower when different components are selected as the monochrome motor 102*d* and the color motor 102*a*.

As described above, even when the microscale driving is performed for the same period of time for each of the monochrome motor 102*d* and the color motor 102*a*, the drive amounts differ from each other. Therefore, by executing the microscale driving sequence for the plurality of times, a tendency of the drive amounts becomes clear. For example, when the drive amount of the monochrome motor 102*d* is larger than the drive amount of the color motor 102*a* during a plurality of times of the microscale driving, it is found that the drive amount of the monochrome motor 102*d* is larger than the drive amount of the color motor 102*a* even during the microscale driving time period Ton.

The microscale driving time period Ton of the monochrome motor 102*d* and the microscale driving time period Ton of the color motor 102*a* may be set different from each other in accordance with the tendency described above. For example, when the drive amount of the monochrome motor 102*d* is larger than the drive amount of the color motor 102*a*, the microscale driving time period Ton of the monochrome motor 102*d* is set shorter than the microscale driving time period Ton of the color motor 102*a*. As a result, a difference between the drive amount of the monochrome motor 102*d* and the drive amount of the color motor 102*a* after the execution of the microscale driving sequence for a plurality of times can be reduced. Moreover, a delay time period at the start of the printing sequence can be reduced to reduce the waiting time for the start of output of the print.

An adjustment amount of the microscale driving time period Ton can be determined in accordance with the characteristics of each of the motors acquired in, for example, an inspection at the time of shipping of the image forming apparatus 100 from a factory. Moreover, the microscale driving time period Ton may be determined dynamically. For example, a subsequent microscale driving time period(s) Ton may be determined at the start of the printing sequence based on the difference between the cumulative drive amounts DN.bk and DN.cl.

As described above, the phase registration between the monochrome motor 102*d* and the color motor 102*a* at the time when the motors are stopped and the microscale driving of the motors can be realized without additionally providing a sensor. As a result, higher quality can be realized for the image to be formed while suppressing an increase in cost of the image forming apparatus 100. Moreover, an increase in time until the start of output of the print can be minimized to prevent operational efficiency of the user from being lowered.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-277699, filed Dec. 20, 2012, which is hereby incorporated by reference herein in its entirety.

What is claimed is:

1. An image forming apparatus for forming a color image, comprising:

a first photosensitive member and a second photosensitive member;

a first motor and a second motor configured to rotate the first photosensitive member and the second photosensitive member, respectively;

a detection section configured to detect rotation phases of the first photosensitive member and the second photosensitive member;

a stop processing section configured to control the first motor and the second motor to stop the first photosensitive member and the second photosensitive member such that the rotation phase of the first photosensitive member and the rotation phase of the second photosensitive member have predetermined relations based on the detected rotation phases of the first photosensitive member and the second photosensitive member, after the end of image formation;

a control section configured to drive the first motor and the second motor at predetermined time intervals without an image formation instruction to rotate the first photosensitive member and the second photosensitive member, respectively, after the stop processing by the stop processing section until a next image formation;

a calculation unit configured to calculate a cumulative value of first rotation amounts of the first photosensitive member and a cumulative value of second rotation amounts of the second photosensitive member after the stop processing by the stop processing section; and a startup control section configured to control the first motor and the second motor to perform a startup process of the first photosensitive member and a startup process of the second photosensitive member based on a difference between the cumulative value of the first rotation amounts and the cumulative value of the second rotation amounts, wherein the startup control section delays the startup process of the first motor from the startup process of the second motor by a time period based on the difference between the cumulative value of the first rotation amounts and the cumulative value of the second rotation amounts when the cumulative value of the first rotation amounts is greater than the cumulative value of the second rotation amounts, and delays the startup process of the second motor from the startup process of the first motor by a time period based on the difference between the cumulative value of the first rotation amounts and the cumulative value of the second rotation amounts when the cumulative value of the second rotation amounts is greater than the cumulative value of the first rotation amounts for the next image formation.

2. The image forming apparatus according to claim 1, wherein the calculation unit calculates the first rotation amount and the second rotation amount based on time periods required for rotation speeds of the first motor and the second motor to become equal to a prescribed rotation speed from activation, drive time periods at the prescribed rotation speed, and the prescribed rotation speed.

3. The image forming apparatus according to claim 2, wherein:

each of the first motor and the second motor outputs a pulse signal when the rotation speed of each of the first motor and the second motor becomes equal to the prescribed rotation speed; and the calculation unit detects the pulse signals output from the first motor and the second motor to measure the time period required for the rotation speed of the first motor to become equal to the prescribed rotation speed from activation and the time period required for the rotation speed of the second motor to become equal to the prescribed rotation speed after activation.

4. The image forming apparatus according to claim 3, wherein:

the control section controls the first motor and the second motor to rotate the first photosensitive member and the second photosensitive member for a constant time period; and the calculation unit calculates the drive time periods at the prescribed rotation speed from a difference between the constant time period and the time required for the first motor and the second motor to become equal to the prescribed rotation speed.

5. The image forming apparatus according to claim 1, wherein, when the image is to be formed by using the second motor without using the first motor, the stop processing section stops the second photosensitive member based on the first rotation amount, which is calculated by the calculation unit, after the image is formed by using the second motor.

6. The image forming apparatus according to claim 5, wherein:

the second motor outputs a pulse signal when a rotation speed of the second motor becomes equal to a prescribed rotation speed;

the calculation unit calculates a pulse number of the pulse signal corresponding to the first rotation amount; and the stop processing section stops the second photosensitive member when the pulse signal having the pulse number calculated by the calculation unit is output from the second motor.

7. The image forming apparatus according to claim 5, wherein:

the first photosensitive member comprises a plurality of photosensitive members on which images of different colors are respectively formed;

the second photosensitive member forms a black image thereon; and a monochrome image is formed by forming the image using the second motor without using the first motor.

8. The image forming apparatus according to claim 1, wherein:

the control section controls the first motor and the second motor to rotate the first photosensitive member and the second photosensitive member for a prescribed time period at a rotation speed lower than a rotation speed during the image formation after the stop processing by the stop processing section.

9. The image forming apparatus according to claim 1, wherein the control section controls the first motor to rotate the first photosensitive member for a first prescribed time period at a rotation speed lower than a rotation speed during the image formation and controls the second motor to rotate the second photosensitive member for a second prescribed time period at a rotation speed lower than a rotation speed during the image formation after the stop processing by the stop processing section.

* * * * *